US008477144B2

(12) United States Patent
Roh

(10) Patent No.: US 8,477,144 B2
(45) Date of Patent: Jul. 2, 2013

(54) IMAGE DISPLAY SYSTEM AND METHOD FOR INCREASING EFFICIENCY OF BUS BANDWIDTH

(75) Inventor: Jong-Ho Roh, Suwon-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 1131 days.

(21) Appl. No.: 12/038,476

(22) Filed: Feb. 27, 2008

(65) Prior Publication Data

US 2008/0266303 A1 Oct. 30, 2008

(30) Foreign Application Priority Data

Feb. 28, 2007 (KR) ..... 10-2007-0020422

(51) Int. Cl.
*G09G 5/36* (2006.01)
*G09G 5/39* (2006.01)

(52) U.S. Cl.
USPC ..... 345/556; 345/531; 345/545

(58) Field of Classification Search
USPC ..... 345/530, 531, 545, 549, 556
See application file for complete search history.

(56) References Cited

U.S. PATENT DOCUMENTS

| | | | | |
|---|---|---|---|---|
| 4,177,462 | A * | 12/1979 | Chung | 345/22 |
| 5,119,082 | A * | 6/1992 | Lumelsky et al. | 345/600 |
| 6,724,391 | B1 * | 4/2004 | Peled et al. | 345/555 |
| 7,728,851 | B2 * | 6/2010 | Kuno | 345/629 |
| 2002/0028061 | A1 | 3/2002 | Takeuchi et al. | |
| 2002/0122109 | A1 * | 9/2002 | Ehsani et al. | 347/240 |
| 2004/0223739 | A1 | 11/2004 | Suzuki et al. | |
| 2006/0092163 | A1 * | 5/2006 | Kuo et al. | 345/522 |
| 2006/0290952 | A1 * | 12/2006 | Owen | 358/1.8 |

FOREIGN PATENT DOCUMENTS

| | | |
|---|---|---|
| JP | 2000-138823 | 5/2000 |
| KR | 1020050014489 | 2/2005 |
| KR | 1020050016325 | 2/2005 |

* cited by examiner

*Primary Examiner* — Joni Richer
(74) *Attorney, Agent, or Firm* — F. Chau & Associates, LLC

(57) ABSTRACT

An image display system includes: a frame buffer having a plurality of lines, each of which stores image data and repetition information of the image data; a memory controller in signal communication with the frame buffer for reading the image data and the repetition information from the frame buffer; a display controller in signal communication with the memory controller for regenerating the image data, which is provided from the memory controller, in accordance with the repetition information provided from the memory controller; and a display device in signal communication with the display controller for displaying the regenerated image data, which is provided from the display controller, under regulation by the display controller.

30 Claims, 3 Drawing Sheets

IMAGE DISPLAY SYSTEM AND METHOD FOR INCREASING EFFICIENCY OF BUS BANDWIDTH

CROSS-REFERENCE TO RELATED APPLICATION

This U.S. non-provisional patent application claims foreign priority under 35 U.S.C. §119 to Korean Patent Application No. 10-2007-20422, filed on Feb. 28, 2007, the entire contents of which are incorporated herein by reference.

BACKGROUND

The present disclosure relates to image display systems, and more particularly, to an image display system and method for increasing efficiency of a bus bandwidth.

In general image display apparatuses, such as liquid crystal display units of mobile phones or monitors of computers, an image is usually expressed by an on-screen display (OSD) mode in a graphical user interface (GUI) environment.

The GUI provides a working environment that enables a user to exchange information with a computer by graphical means. The GUI permits a user to order a task by selecting one of several menu items on a screen with an input unit, such a mouse. Components of the GUI may include task windows, scroll bars and icon images. While there are some differences between types of monitors, adjustable items for screens normally include brightness, contrast, RGB coordination, regulation of vertical and horizontal screen size, positioning, and the like.

In presenting an OSD image for a GUI to an image display system, most image regions are composed of highly repetitive image data on the characteristics of OSD image. For example, when a user adjusts a window size on a monitor screen, non-adjustable parts of the window are the image regions that do not change. Those window parts repeatedly display the same image data.

In an image display system, image data are fetched from an external or internal memory and then applied to a display unit thereof. During this, the image display system operates to recognize highly repetitive image data as independent. Thus, the image display system repeatedly accesses the memory for the same image data in order to display the highly repetitive image data.

As an image display system conducts such unnecessary accesses to the memory in order to display the highly repetitive image data, it increases the quantity of data that must be processed per unit of time, thereby reducing efficiency. Therefore, such image display systems are disadvantageous to the efficiency of a bus having limited bandwidth.

SUMMARY OF THE INVENTION

The present disclosure addresses the aforementioned drawbacks and disadvantages of the prior art, providing an image display system and method that are capable of improving the efficiency of a bus having limited bandwidth.

An exemplary embodiment of the present disclosure is an image display system including: a frame buffer having a plurality of lines, each of which stores image data and repetition information for the image data; a memory controller for reading the image data and the repetition information from the frame buffer; a display controller for regenerating the image data, which is provided from the memory controller, in accordance with the repetition information provided from the memory controller; and a display device for displaying the regenerated image data, which is provided from the display controller, under regulation by the display controller.

Here, each line of the frame buffer comprises a plurality of cells, each of which may comprise a dummy field for storing the repetition information and an image data field for storing the image data. The cell of the frame buffer may be composed of 32 bits. The dummy field may be composed of the higher-order 8 bits of the 32 bits, and the image data field may be composed of the lower-order 24 bits. The image data may be pixel data. The image data may include information for red, blue, and green, which are sequentially stored in the image data field. The display device may include lines correspondent with the lines of the frame buffer, each of which correspondingly displays the image data of the line of the frame buffer.

In addition, the display controller may include: a direct memory access block for receiving the image data and the repetition information from the memory controller; a repeat controller for receiving the image data and the repetition information from the direct memory access block and analyzing the repetition information; a pixel scheduler for regenerating the image data, which is provided from the repeat controller, in response to the analyzed repetition information provided from the repeat controller; and a timing controller for regulating the pixel scheduler. The pixel scheduler may provide the regenerated image data to the display device under regulation by the timing controller.

The repetition information may contain repeat-cycle information and repeat-enablement information. The repeat-cycle information represents the number of repetition cycles for the image data. The repeat-enablement information represents an enabling status to regenerate the image data. The repeat-enablement information may be stored at the highest bit location of the cell of the frame buffer. If the repeat-enablement information of the analyzed repetition information is active, the pixel scheduler may regenerate the image data as many times as the number of repetition cycles according to the repeat-cycle information. The pixel scheduler may provide the image data to the display device if the repeat-enablement information of the analyzed repetition information is inactive.

Another exemplary embodiment of the present disclosure is a method for displaying an image on an image display system that has a frame buffer including a plurality of lines, each of which stores image data and repetition information for the image data. The method comprises: reading the image data and the repetition information from the frame buffer; regenerating the image data in accordance with the repetition information; and displaying the regenerated image data.

Here, the line of the frame buffer comprises a plurality of cells, each of which comprises a dummy field for storing the repetition information and an image data field for storing the image data. The cell of the frame buffer may be composed of 32 bits. The dummy field may be composed of the higher-order 8 bits of the 32 bits. The image data field may be composed of the lower-order 24 bits. The image data may be pixel data. The image data may include information for red, blue, and green, which are sequentially stored in the image data field.

Regenerating the image data may comprise: providing the image data and the repetition information; analyzing the repetition information; and regenerating the image data in response to the analyzed image data. The repetition information contains repeat-cycle information and repeat-enablement information. The repeat-cycle information represents the number of repetition cycles for the image data. The repeat-enablement information represents an enabling status to regenerate the image data. The repeat-enablement information may be stored at the highest-order bit location of the cell of the frame buffer.

Regenerating the image data may further comprise regenerating the image data as many times as the number of repetition cycles according to the repeat-cycle information from the pixel scheduler if the repeat-enablement information of the analyzed repetition information is active. The method may further comprise displaying the image data if the repeat-enablement information of the analyzed repetition information is inactive.

A further understanding of the nature and advantages of the present disclosure herein may be realized by reference to the remaining portions of the specification and the attached drawings.

BRIEF DESCRIPTION OF THE DRAWINGS

Non-limiting and non-exhaustive embodiments of the present disclosure will be described with reference to the following exemplary figures, wherein like reference numerals may refer to like parts throughout the various figures, in which.

DETAILED DESCRIPTION OF PREFERRED EMBODIMENTS

Figure 1:
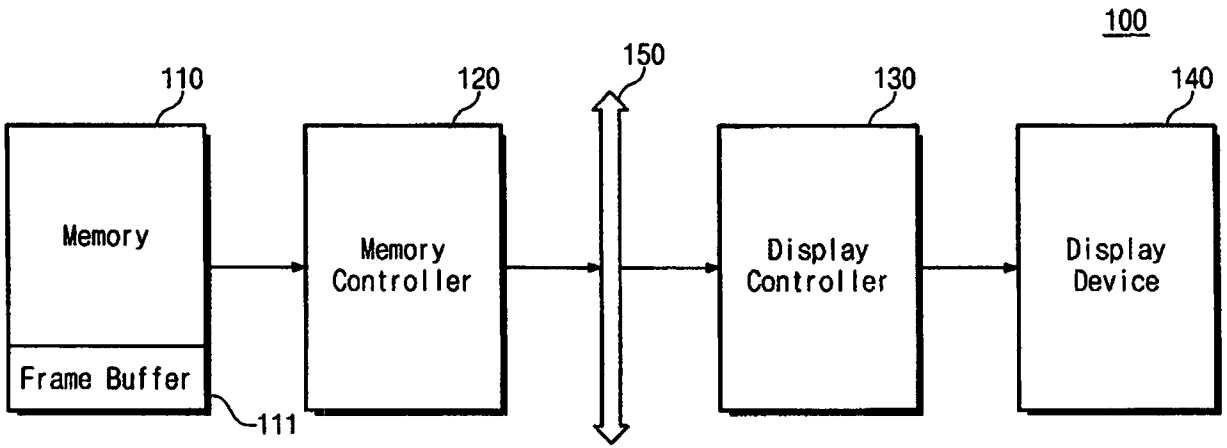
FIG. 1 is a block diagram of an image display system according to an embodiment of the present disclosure.

Preferred embodiments of the present disclosure are described below in further detail, with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Like reference numerals may refer to like elements throughout the accompanying figures.

According to an image display system of the present disclosure, highly repetitive image data are regenerated by a display controller, without repeatedly fetching them from a frame buffer, by means of image repetition information saved in the frame buffer. The regenerated image data are provided to a display unit. Therefore, the image display system of the present disclosure is able to reduce the quantity of data to be processed per unit of time because there is no need to conduct unnecessary memory accesses. Thus, preferred embodiments raise the efficiency of a bus having limited bandwidth.

Hereinafter, an exemplary embodiment of the present disclosure is described in conjunction with the accompanying drawings.

FIG. 1 is a block diagram of an image display system according to an embodiment of the present disclosure. Referring to FIG. 1, the image display system 100 is comprised of a memory 110, a memory controller 120 coupled in signal communication with the memory, a display controller 130 coupled in signal communication with the memory controller, and a display device 140 coupled in signal communication with the display controller.

The memory 110 includes a frame buffer 111 for storing image data. The frame buffer 111 is organized by including a plurality of memory cells arranged in rows and columns. The rows correspond with lines. The frame buffer 111 corresponds to the display device 140 in terms of size. For instance, if the display device 140 has a panel of 320×240 pixels, the frame buffer 111 is formed of 240 lines (i.e., rows). Each line is composed of memory cells (hereinafter, referred to as 'cells') corresponding to 320 pixels. The display device 140 supporting the array of 320×240 pixels is configured to display 320-pixel data on each of 240 lines. The cells of the frame buffer 111 store image data, which are to be applied to the display device 140, as well as repetition information of the image data. Here the image data is pixel data. Thus, each of the 240 lines of the frame buffer 111 stores 320 pixels of data and the repetition information for the 320-pixel data.

Image data stored in each cell of the frame buffer 111 is image information to be presented on the display device 140. Repetition information stored in each cell of the frame buffer 111 means information about repetition cycles to be displayed (hereinafter, 'repeat-cycle information'), and information about repetition enablement to repeat display (hereinafter, 'repeat-enablement information'). The memory controller 120 reads image data and repetition information from the cells of the frame buffer 111, and provides the read image data and repetition information into the display controller 130 by way of a system bus 150.

The display controller 130 analyzes the repetition information provided by the memory controller 120, and determines how to regenerate the image data in accordance with the analyzed repetition information. The repetition information contains the repeat-cycle information and repeat-enablement information. If repeat-enablement information of image data input thereto is active, the display controller 130 regenerates the image data as many times as the cycle times according to the repeat-cycle information of the image data corresponding to the active repeat-enablement information. The display controller 130 applies the regenerated image data to the display device 140. If, on the other hand, the repeat-enablement information of image data input thereto is inactive, the display controller 130 provides the display device 140 with the image data having the inactive repeat-enablement information.

The display device 140 displays image data that is provided thereto by the display controller 130. As a line on the display device 140 corresponds to the line (i.e., row) of the frame buffer 111, image data read from an arbitrary line of the frame buffer 111 are sequentially displayed along its corresponding line of the display device 140.

As explained above in connection with the background in this art, while an image display system is displaying images on a display device, there are highly repetitive image data. However, in the image display system 100 according to the present disclosure, the display controller 130 regenerates the highly repetitive image data, without repeatedly reading the image data from the frame buffer 111 of the memory 110, by means of the repetition information of the image data stored in the frame buffer 111. Thus, the image display system 100 is able to reduce the quantity of data that must be processed per unit of time because there is no need to conduct unnecessary memory accesses. Thus, the efficiency is improved for a bus having limited bandwidth.

Figure 2:
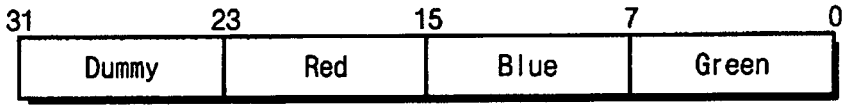
FIGS. 2 and 3 are diagrams illustrating cell configurations of the frame buffer shown in FIG. 1.
Figure 3:
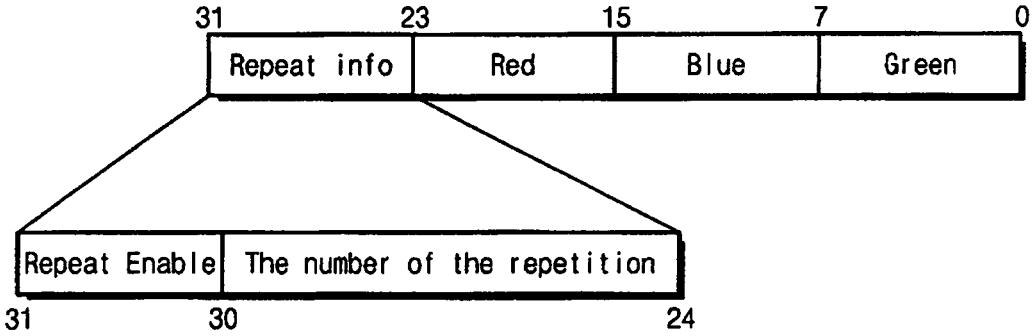

FIGS. 2 and 3 are diagrams illustrating cell configurations of the frame buffer shown in FIG. 1. Referring to FIG. 2, the cell of the frame buffer 111 is composed of 32 bits. In the cell of the frame buffer 111, from 0-bit (the first bit) to 23-bit (the 24th bit) is an image data field and from 24-bit (the 25th bit) to 31-bit (the 32nd bit) is a dummy field. The image data field stores image information to be applied to the display device 140, including information for red, blue and green. The red, blue and green information is provided to the display device 140 by the display controller 130.

In practice, the red, blue and green information of the image data field may be mixed to become an image signal by a multiplexer or a mixer of the display controller 130, for example. The image signal is provided into the display device 140. Thus, a procedure for providing image data to the display device 140 may further include the step of mixing the red, blue and green information of the image data field.

The dummy field of the cell of the frame buffer 111 stores the repetition information of the image data. The image display system 100 according to this exemplary embodiment employs the dummy field as a region for storing the repetition information of image data, so it is able to more efficiently utilize the storage area of the frame buffer 111.

Referring to FIG. 3, the dummy field of the cell of the frame buffer 110 according to an embodiment of the present disclosure stores the repetition information of image data. The repetition information includes the repeat-cycle information and the repeat-enablement information. The range of the dummy field, from 24-bit (the 25th bit) to 30-bit (the 31st bit), is provided for storing the repeat-cycle information of the image data. The 31-bit (the 32nd bit) of the dummy field is provided for the repeat-enablement information. The repetition information is predetermined and stored in the frame buffer 111 along with image data corresponding thereto while storing the image data.

In the image display system 100, while presenting an image on the display device 140, there are highly repetitive image data. When such highly repetitive image data is stored in the cell of the frame buffer 111, repeat-enablement information is actively reserved therein and repeat-cycle information is also reserved therein to indicate the number of repetition cycles for the image data. When non-repetitive image data is stored in the cell of the frame buffer 111, repeat-enablement information is inactively reserved therein while the dummy field is not used for repeat-cycle information.

Figure 4:
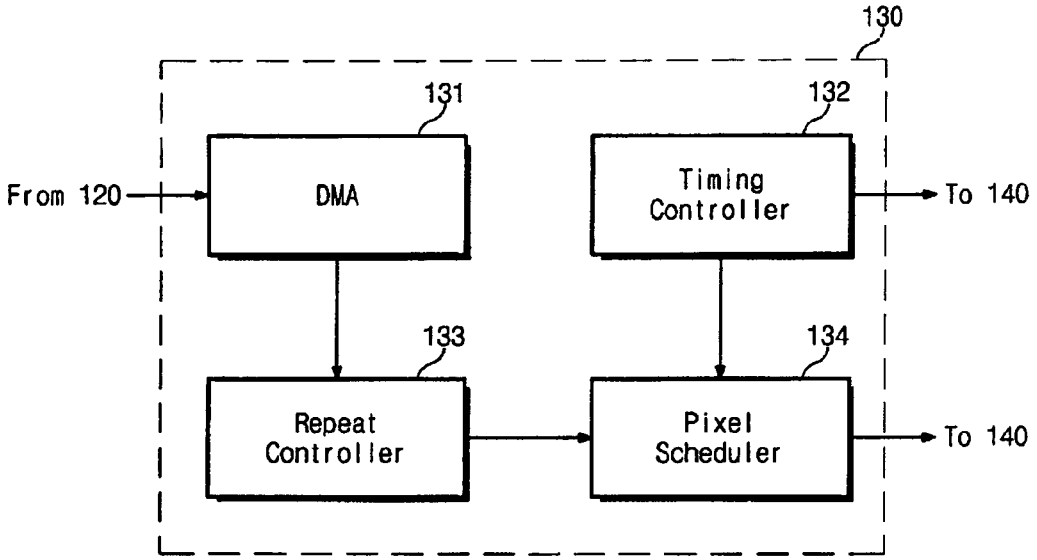
FIG. 4 is a block diagram of the display controller shown in FIG. 1.

FIG. 4 is a block diagram of the display controller shown in FIG. 1. Referring to FIG. 4, the display controller 130 according to this exemplary embodiment the present disclosure is comprised of a direct memory access (DMA) block 131, a timing controller 132, a repeat controller 133, and a pixel scheduler 134.

As described with respect to FIG. 1, the memory controller 120 reads image data and repetition information for the image data from each cell of the frame buffer 111 in the memory 110. The DMA block 131 of the display controller 130 accepts the image data and the repetition information from the memory controller 120 by way of the system bus 150. Practically, the DMA block 131 accesses the frame buffer 111 of the memory 110 by the memory controller 120, reading and fetching the image data and the repetition information. The DMA block 131 may be provided with the image data and repetition information from the frame buffer 111 of the memory 110.

The DMA block 131 provides the repeat controller 133 with the accepted image data and repetition information. The repeat controller 133 provides the image data to the pixel scheduler 134. The repeat controller 133 analyzes the repetition information and provides the analyzed repetition information to the pixel scheduler 134. The repetition information is analyzed into the repeat-enablement information and the repeat-cycle information. The repeat-enablement information denotes an enabling status to repeatedly display the image data, and the repeat-cycle information denotes the number of repetition cycles of the image data.

The pixel scheduler 134 receives the analyzed repetition information. If the enabling status of image data input thereto is inactive, the pixel scheduler 134 outputs the image data to the display device 140. On the other hand, if the enabling status of image data is active, the pixel scheduler 134 regenerates the image data as many as the number of repetition cycles. The pixel scheduler 134 provides the regenerated image data to the display device 140.

The timing controller 132 regulates the timing of the display device 140 so as to sequentially display image data on each line of the display device 140. In operation, the image data read from an arbitrary line of the frame buffer 111 may be sequentially presented on the corresponding line of the display device 140. For this operation, the timing controller 132 regulates timings of the pixel scheduler 134 and the display device 140 so as to sequentially supply image data to the display device 140 from the pixel scheduler 134.

The display device 140 operates to display the image data, which are provided from the pixel scheduler 134, under the regulation by the timing controller 132. As a result, in the image display system 100, the display controller 130 regenerates highly repetitive image data without repeatedly reading the image data from the frame buffer 111 of the memory 110, by means of using the image data repetition information stored in the frame buffer 111.

Through this operation, the image display system 100 is able to reduce the quantity of data that must be processed per unit of time because there is no longer any need to conduct unnecessary memory accesses, thereby improving efficiency of the bus bandwidth therein. Thus, exemplary embodiments, according to the present disclosure, are able to raise the efficiency of the bus bandwidth in an image display system.

The above-disclosed subject matter is to be considered illustrative rather than restrictive, and the appended claims are intended to cover all such modifications, enhancements, and other embodiments that fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description of preferred embodiments.

What is claimed is:

1. An image display system comprising:

a frame buffer having a plurality of lines, each line of which stores image data and repetition information corresponding to a plurality of pixels of the image, wherein each of the lines of the frame buffer comprises a plurality of words, wherein each word includes a repeat field for storing the repetition information and an image data field for storing the image data;

a memory controller in signal communication with the frame buffer for reading the image data and the repetition information from the frame buffer; and a display controller in signal communication with the memory controller for regenerating the image data of a first pixel in accordance with the repetition information of the first pixel.

2. The image display system as set forth in claim 1, wherein each of the lines of the frame buffer comprises a plurality of words implemented by a plurality of memory cells.

3. The image display system as set forth in claim 1, wherein each word of the frame buffer is composed of 32 bits.

4. The image display system as set forth in claim 3, wherein the repeat field is the higher-order 8 bits of the 32 bits.

5. The image display system as set forth in claim 3, wherein the image data field is the lower-order 24 bits of the 32 bits.

6. The image display system as set forth in claim 1, wherein the image data includes pixel color data.

7. The image display system as set forth in claim 6, wherein the image data includes information for red, blue and green, which are stored three subfields in the image data field.

8. The image display system as set forth in claim 1, further comprising:

a display device in signal communication with the display controller for displaying the regenerated image data of the first pixel under regulation by the display controller, wherein the display device comprises lines that correspond one-to-one with the lines of the frame buffer, and each line of the display device displays the image data of the corresponding line of the frame buffer.

9. The image display system as set forth in claim 1, wherein the display controller comprises:

a direct memory access (DMA) block for receiving the image data and the repetition information from the memory controller;

a repeat controller in signal communication with the DMA block for receiving the image data and the repetition information from the direct memory access block and for analyzing the repetition information;

a pixel scheduler in signal communication with the repeat controller for regenerating the image data of a first pixel in response to the analyzed repetition information of the first pixel; and a timing controller in signal communication with the pixel scheduler for regulating the pixel scheduler, wherein the pixel scheduler provides the regenerated image data of the first pixel to a display device under regulation by the timing controller.

10. The image display system as set forth in claim 9, wherein the repetition information of the first pixel contains repeat-cycle information and repeat-enablement information.

11. The image display system as set forth in claim 10, wherein the repeat-cycle information of the first pixel represents the number of repetition cycles for the image data of the first pixel.

12. The image display system as set forth in claim 10, wherein the repeat-enablement information represents an enabling status to regenerate the image data of the first pixel.

13. The image display system as set forth in claim 10, wherein the repeat-enablement information of the first pixel is stored at the highest-order bit location of a word corresponding to the first pixel stored in the frame buffer.

14. The image display system as set forth in claim 10, wherein the pixel scheduler regenerates the image data of the first pixel as many times as the number of repetition cycles according to the repeat-cycle information of the first pixel, if the repeat-enablement information of the analyzed repetition information of the first pixel is active.

15. The image display system as set forth in claim 10, wherein the pixel scheduler sequentially provides the updated image data of the first pixel to a display device, while the repeat-enablement information of the analyzed repetition information of the first pixel is inactive.

16. A method for sequentially displaying a plurality of images on an image display system having a frame buffer including a plurality of lines, each line of which stores image data and repetition information of a plurality of the method comprising:

reading the image data and the repetition information of each pixel of a first line of a first image from the frame buffer;

regenerating the image data of each pixel of the first line of the first image in accordance with the repetition information;

displaying, on an image display device, the regenerated image data of each pixel of the first line of the first image; and wherein each of the lines of the frame buffer comprises a plurality of words, each of which corresponds to one pixel and comprises a repeat field for storing the repetition information of the one pixel and an image data field for storing the image data of the one pixel.

17. The method as set forth in claim 16, wherein each word in the frame buffer is 32 bits.

18. The method as set forth in claim 17, wherein the repeat field is the higher-order 8 bits of the 32 bits.

19. The method as set forth in claim 17, wherein the image data field is the lower-order 24 bits.

20. The method as set forth in claim 19, wherein the image data includes information for red, blue and green, which are stored in three subfields in the image data field.

21. The method as set forth in claim 16, wherein the image data is pixel data.

22. The method as set forth in claim 16, wherein regenerating the image data comprises:

providing the image data of each pixel and the repetition information;

analyzing the repetition information of each pixel; and regenerating the image data of each pixel in response to the analyzed repetition information.

23. The method as set forth in claim 22, wherein the repetition information of each pixel contains repeat-cycle information and repeat-enablement information.

24. The method as set forth in claim 23, wherein the repeat-cycle information of each pixel represents the number of repetition cycles for the image data of that pixel.

25. The method as set forth in claim 23, wherein the repeat-enablement information of each pixel represents an enabling status to regenerate the image data of that pixel.

26. The method as set forth in claim 23, wherein the repeat-enablement information of each pixel is stored at the highest-order bit location of a word stored in the frame buffer.

27. The method as set forth in claim 23, wherein regenerating the image data further comprises:

regenerating the image data of each pixel as many times as the number of repetition cycles according to the repeat-cycle information of each pixel if the repeat-enablement information of its analyzed repetition information is active.

28. The method as set forth in claim 23, further comprising:

sequentially displaying the updated image data of each pixel if while the repeat-enablement information of its analyzed repetition information is inactive.

29. An image processing device comprising:

a memory controller in signal communication with a frame buffer configured to read from the frame buffer the image data and the repetition information corresponding to a plurality of pixels for the image data, wherein the repetition information of each one pixel and the image data of each same one pixel is stored in a word corresponding to the one pixel in the frame buffer, and wherein the frame buffer stores a plurality of words corresponding to the plurality of pixels; and a display controller configured to regenerate the image data in accordance with the repetition information provided from the memory controller in response to a first signal from the memory controller or a second signal through a user interface.

30. The image processing device in claim 29, wherein the display controller comprises:

a direct memory access (DMA) block configured to receive the image data and the repetition information from the memory controller;

a repeat controller in signal communication with the DMA block configured to receive the image data and the repetition information from the direct memory access block and to analyze the repetition information;

a pixel scheduler in signal communication with the repeat controller configured to regenerate the image data of a first pixel in response to the analyzed repetition information of the first pixel; and a timing controller in signal communication with the pixel scheduler configured to regulate the pixel scheduler, wherein the pixel scheduler provides the regenerated image data of the first pixel to a display device under regulation by the timing controller.

* * * * *